United States Patent [19]

Pietroni

[11] 3,980,244

[45] Sept. 14, 1976

[54] COIL WINDING MACHINE FOR THE CONTINUOUS WINDING OF COILS, IN PARTICULAR OF METAL WIRE COILS

[75] Inventor: Piero Pietroni, Ascoli Piceno, Italy

[73] Assignee: Technofil S.p.A., Ascoli Piceno, Italy

[22] Filed: June 10, 1975

[21] Appl. No.: 585,678

[30] Foreign Application Priority Data

June 17, 1974 Italy ..... 3418/74

[52] U.S. Cl. ..... 242/25 A

[51] Int. Cl.[2] ..... B65H 54/02

[58] Field of Search ..... 242/25 R, 25 A, 18 R, 242/18 A, 54 R

[56] References Cited

UNITED STATES PATENTS

| | | | |
|---|---|---|---|
| 2,863,613 | 12/1958 | Bunch | 242/25 A |
| 2,893,652 | 7/1959 | Davis | 242/25 A |
| 2,932,462 | 4/1960 | Nelson | 242/25 A |
| 3,323,735 | 6/1967 | Diehl | 242/25 A |
| 3,327,957 | 6/1967 | Trenerry | 242/25 A |
| 3,596,844 | 8/1971 | Engmann | 242/25 A |
| 3,693,898 | 9/1972 | Otani | 242/25 A |

*Primary Examiner*—John Petrakes

*Attorney, Agent, or Firm*—Browdy and Neimark

[57] ABSTRACT

A wire coiling machine for the continuous winding of metal wire coils, of the type comprising supporting and pulling means for the driving of two reels with parallel axes, wire gripping means and wire guide means ensuring the uniform distribution of the wire to be wound, has arms or similar devices ensuring that the wire is passed from a completed coil to a new reel for starting another coil without having to interrupt the coiling operation and that the length of wire is maintained when passing from one coil to the next one always of the same length without exposing it to stresses which might cause breaking thereof.

9 Claims, 6 Drawing Figures

A
B
C
D
II
1
7
8
9
10
11
12
13
18
20
21
22
22a
22b
24
25
28
29
30
31
35
35a
35b
35c
35d
50
51
52
53
61

COIL WINDING MACHINE FOR THE CONTINUOUS WINDING OF COILS, IN PARTICULAR OF METAL WIRE COILS

BACKGROUND OF THE INVENTION

The present invention relates to a coil winding machine for the continuous winding of coils, in particular of metal wire coils, as used for transporting the wound wire.

DESCRIPTION OF THE PRIOR ART

The known coil winding machines essentially consist of a supporting frame carrying a dead center and a live center axially moveable, both centers being designed to carry revolvingly a supporting reel for the winding up of a wire being fed from an operating machine positioned upstream thereof, to form a coil.

Suitable devices are provided for rotating the reel during the coiling phase; essentially, a motor is connected to a disk coaxially seated to the said centers, the said disk carrying an entraining device which, by acting on a lateral disk integral with part of the reel causes the latter to follow its motion.

The said entraining disk is provided at its periphery with a hollow cylindrical secton projecting to cover a lateral disk of the reel.

The said cylindrical section can be an integral part of the entraining disk (flange strap).

The wire being fed in from the wire supply machine is led around an idler pulley carried by the piston rod of a hydraulic cylinder, then wound up onto the reel.

The pulley, according to the motion of the rod, follows an alternating rectilinear path parallel to the reel axis with the speed controlled in function of the speed of rotation of the reel and the pitch the said winding is supposed to have.

The device comprising a pulley and elements ensuring the alternating motion is called a wire guide.

In the known coil winding machines, each time a coil has been completed, the wire feed-in must be interrupted so that the finished coil can be removed from the machine and a new reel inserted, and to fix the leading end of the wire to the new reel.

Increasing coiling speeds and labor costs make the use of continuous coiling machines always more advantageous, that is machines allowing a continuous, uninterrupted operation without having to slow down even during unloading of the finished coil and loading of the empty reel and without the need of the attendant's intervention.

For this purpose, several types of wire coiling machines have been developed, a first type of which comprises two reels with their axes parallel, carried by a disk rotating around an axis parallel to those of the reels.

When a coil is completed the said disk is so rotated that the groove of the empty reel comes into contact with the wire moving around the finished coil.

The lateral disk of each center is provided with suitable wire gripping devices, substantially with blades projecting over the said flange straps which, when gripping the wire, break it because of the difference in speed between the two reels and entraining the new leading end to be coiled around the empty reel.

The transfer of the wire from the finished coil to the empty reel takes place without the need of stopping the wire or slowing it down and without the attendant's intervention.

It is evident that the empty reel must be brought to a speed corresponding to that of the winding phase.

This first type of coiling machine is, however, characterized by numerous constructional difficulties caused in part by the difficulty of transmitting the motion and other operational steps to the dead and live centers and for this reason more economical and simpler machines with reels having axes rotating at fixed speeds have been looked for.

One machine possessing these characteristics has two reels having parallel axes.

The wire arriving from the wire-guide pulley is first wound on one reel and, as soon as the coil is completed, two auxiliary sheaves moving horizontally displace the wire in the path between the wire guide and the coil bringing it tangential to the groove of the second reel already rotating at the desired speed.

In this position the wire is now gripped by the gripping elements of the second reel, broken because of the existing kinematic incompatibility between the motion of the two reels and drawn in to be coiled onto the second reel. The transfer of the wire from the full reel to the empty one is thus obtained without having to slow down or interrupt the feed of wire from the wire supply machine and without the need of manual operation by the attendant.

The use of the two extra sheaves ensures that one of the two sheaves (the one displacing the wire) is accelerated by the wire itself while being speeded up from zero speed to the peripheral speed of the wire though always lagging because of the inevitable sliding effect.

This effect causes an increase in the stresses in the wire with the therefrom ensuing danger of breaking or sliding of the wire along the surface of the sheave and deterioration thereof.

In addition, the displacement of the wire obtained by using the auxiliary sheaves, as compared to the steady state operation, causes an increase in call for wire and thus the engagement of the speed adjusting device controlling the supply of wire to the machine.

Another drawback is the increase in distance between the reel and the wire-guide pulley caused by the intercalation of the auxiliary sheaves, distance which to ensure the uniform laying of the turns during the coil phase should be as short as possible.

SUMMARY OF THE INVENTION

It is the principal object of the present process to overcome the said drawbacks by means of a coiling machine in which the passage of the wire from a completed coil to an empty reel takes place without a sensible variation in the wire feed speed and without the need for intercalated elements which might easily deteriorate or even break the wire during coiling.

It is another object of the present invention to keep the wire-guide pulley constantly in a position as close as possible to the reel onto which the wire is coiled. These objects are obtained by the coiling machine of the present invention, this machine being of the type comprising means for supporting, entraining and rotating two reels having parallel axes, provided with means for gripping the wire carried by the entraining means, a wire guide complete with pulley for the uniform distribution of the wire to be coiled, comprising : a first arm carrying the wire guide oscillating between two extreme positions it is reaching during the passage of the wire from a completed coil to an empty reel, with the wire being coiled brought now into contact with the groove of the empty reel; a second oscillating arm subjected to an oscillating motion associated to the motion of the first arm, carrying at least one idler pulley partially receiving the wire before the same reaches the wire-guide pulley; a locator body with a vertical edge in intermediate position between the two reels at such a level that it will intercept the wire while passing; automatically or manually controlled thrust means for moving the locator body into that position in which the vertical edge pushes the intercepted wire into the zone where the gripping elements of the empty reel can take it up; a vertical rod at the level of the vertical edge, driven by a automatically or manually controlled lever system, provided for ensuring movement, in close cooperation with the motion of the locator body, oscillating between two extreme positions lateral to the vertical edge of the locator body and maintaining during the passages of the wire the length of wire between the completed coil and the rod outside of the range of the intercepting elements controlled by part of the gripping elements belonging to the completed coil reel.

BRIEF DESCRIPTION OF THE DRAWINGS

Still further details of the present invention will become evident from the detailed description of a preferred embodiment thereof without being limited thereto and on hand of the accompanying drawings in which:

FIG. 5 and FIG. 6 are a simplified front elevation of a second and a third embodiment of the coil winding machine here referred to.

Figure 1:
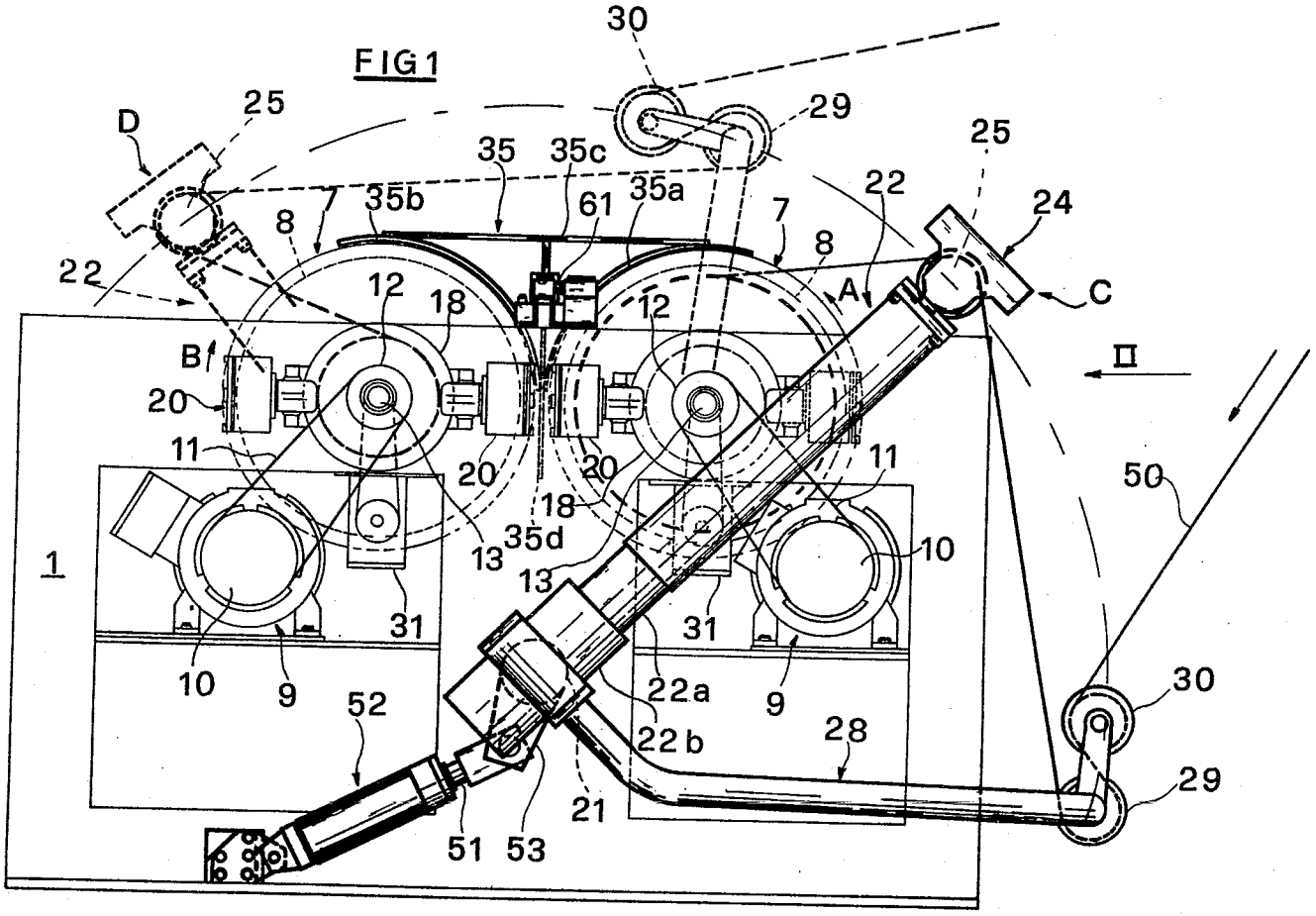
FIG. 1 is a front elevation of the coiling machine of the present invention.

In the said drawings all the parts common to other known machines are drawn in thin lines, the parts relating to new elements object of the present invention in thick ones.

DESCRIPTION OF THE PREFERRED EMBODIMENTS

In the said drawings, 1 is a supporting frame for all the parts of the machine.

2*a* and 2*b* are two reels with parallel and horizontal axes supported by two dead centers 3*a*and 3*b* and two axially movable live centers 4*a* and 4*b*.

The said dead and live centers support the reels by truing them up by means of truncated cones 5 fixed to the ends thereof.

Two electric motors 9 ensure the rotation of the two centers by means of a transmission comprising a pulley 10 driven by the motor, a belt 11 and a second pulley 12 keyed to the shaft 13 of the center.

The two centers each carry near the truncated cones 5 an entraining disk 7 provided on the surface turned toward the live center with friction gaskets 7' which act on a lateral disk 8 of its reel entraining the latter to follow its rotary motion.

The directions of the motion of the disks 7 are shown by arrows A and B in FIG. 1.

The dead centers act as second fixing element and supporting device for the reels and their truing. Each live center is axially sliding and is supported by a cylinder 14 with a hydraulically or pneumatically driven piston 15.

The supporting cylinder 14 carries also an axial stop for the live centers when acting as supporting means, not shown in the drawings because known.

The diameter of the entraining disk 7 is larger than that of the lateral disk 8 of the reel and carries on the edge a cylindrical trunk-like projection 19, pointing cantilever-like in direction of the live centers, called hereinafter flange strap.

The said flange straps carry the wire-gripping elements, in this embodiment blades 16 pointing toward the reel and forming tangents along the periphery of the strap.

The said blades are fixed at one end to the flange strap forming an acute angle with its face turned toward the live centers.

The shaft 13 of each center carries a disk 18 interacting during the braking phase with the brakes 20.

In the lower part of the supporting frame, on the side carrying the means controlling the movement and braking of the centers, equidistant from the reel axes carried by the live and dead centers, there is a fulcrum 21 with its axis parallel to the reel axes 2*a* and 2*b* and an arm 22 pendularly oscillating between two extreme positions, carrying at the upper end a wire guide 24 which controls the distribution of the wire during the coiling phase.

The said arm 22 is controlled by a cylinder 52 having a hydraulically operated piston, the rod 51 of which is pivoted to a lever 53 connected at the fulcrum 21 to the arm 22.

The said cylinder 52 has its fulcrum at base of the supporting frame 1.

The arm 22 consists of two parts 22*a* and 22*b* sliding one against the other with the part 22*a* seated partially inside the parts 22*b* so that it is possible to adjust the length of the said arm 22 and therewith the distance of the device from the reel; suitable means are provided for locking the two sliding parts in their relative position as desired.

The wire guide 24 comprises an idler pulley 25 seated at the end of a rod 23 of the piston of a hydraulic cylinder 26.

The said cylinder 26 has its axis parallel to those of the reel 2*a* and 2*b*, the piston is interlocked with an electronic control circuit of known type comprising fixed stop dogs 26*a* and 26*b* and a contact 27 carried by a mobile rod 27' integral part of rod 23.

Two hydraulic pumps 31 are connected to the electronic control circuit for controlling in turn the reciprocation of the cylinder 26 and are moved by the shafts 13 of the centers in such a way that the said idler pulley 25 has impressed thereon an alternating rectilinear motion parallel to the axis of the reel with a speed proportional to the speed of rotation of the reels in function of the desired coiling pitch; the length of the stroke is controlled by the reciprocal distance of the contacts 26*a* and 26*b*.

The said contacts 26*a* and 26*b* are positioned on micrometric screws 31*a* and 31*b* which allow their distance to be varied, varying thereby also the movement of the rod 23 in function of the length of the core of the reel being coiled.

Figure 2:
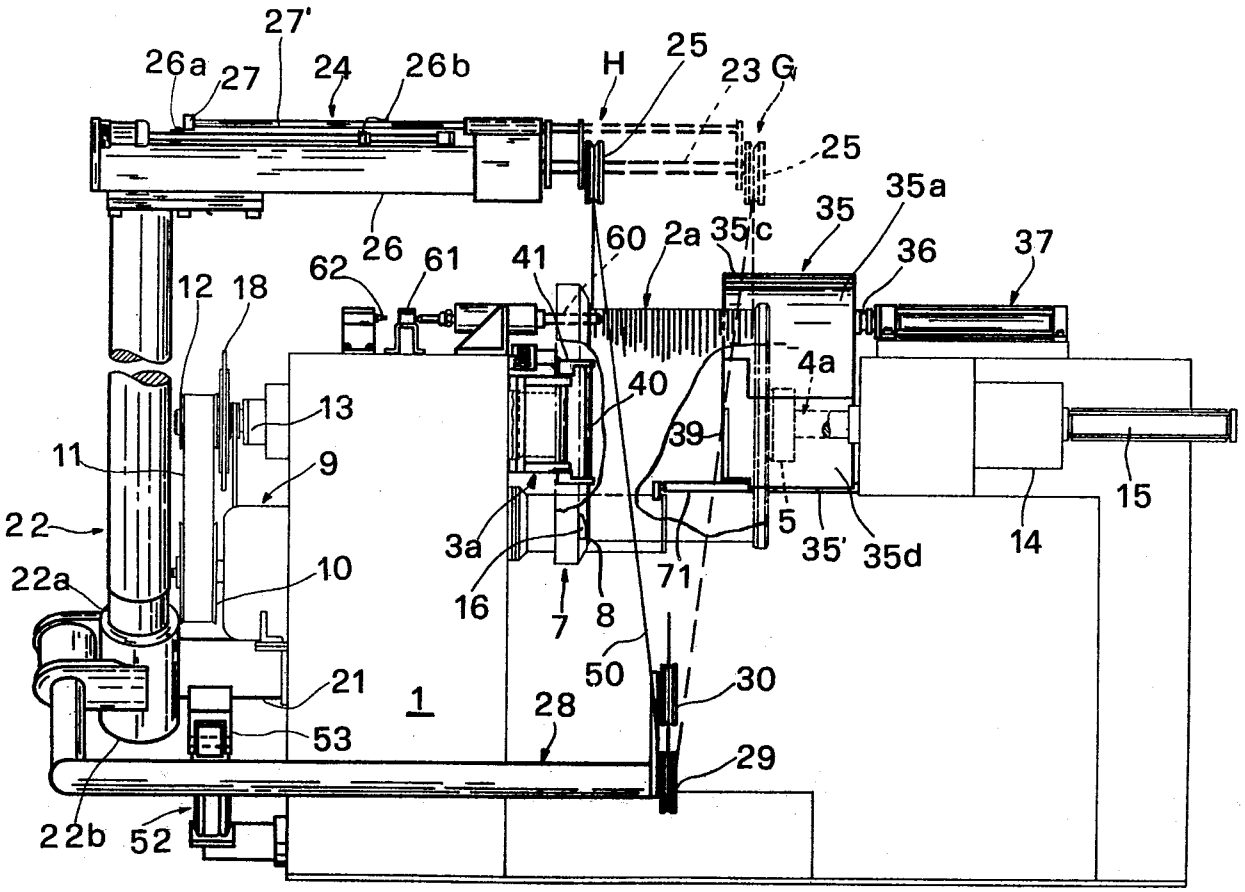
FIG. 2 is a side elevation of the machine shown in FIG. 1 looked at in the direction of the arrow II.
Figure 3:
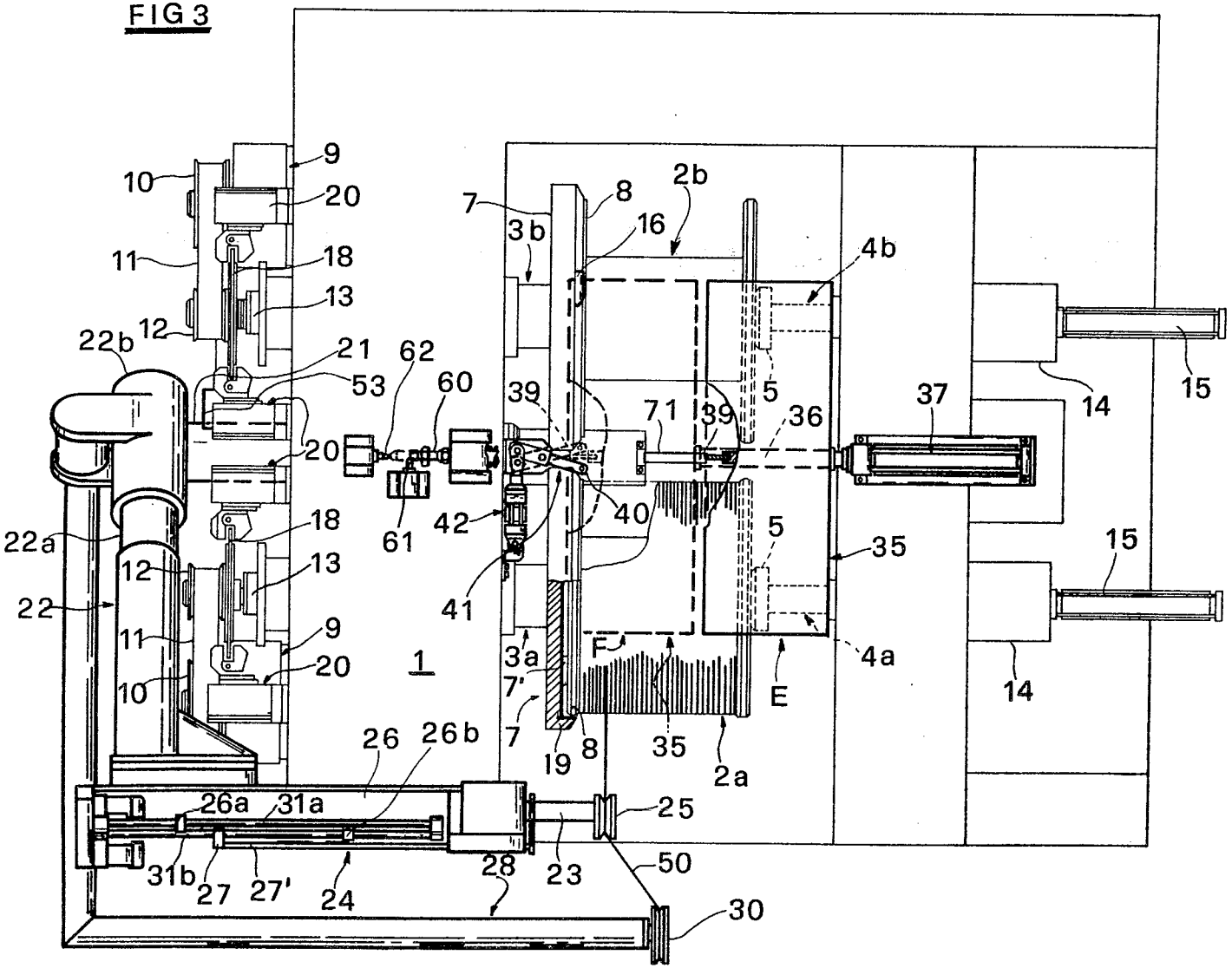
FIG. 3 is a plan view of the machine seen from the top.
Figure 4:
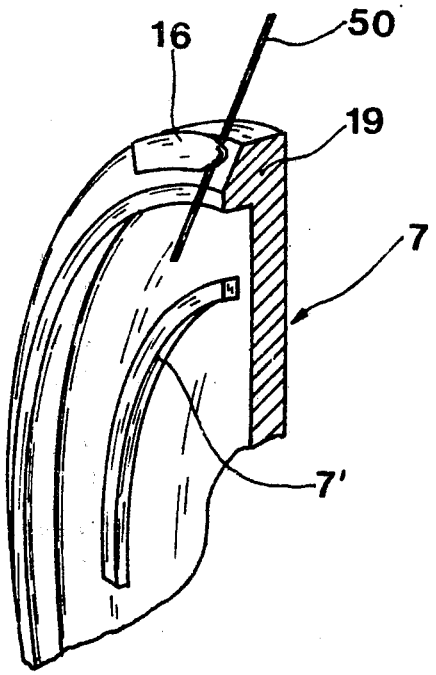
FIG. 4 is an enlarged detail showing a gripping element.

In the first embodiment of the coiling machine of the present invention as shown in FIGS. 1, 2 and 3, a second arm 28 is rigidly fixed near the fulcrum 21 to the first arm 22, the second arm 28 carrying at the free end two idler pulleys 29, 30 slightly spaced from one another.

The wire 50 coming from a wire supplying machine upstream of the coiling machine (not shown), is first coiled around the pulley 30, then around the pulley 29, then to pulley 25 of the wire guide and then to one of the two reels.

The full line in the drawings shows the position C of the pulleys 25, 29, 30 and wire 50 during the moment in which the arm 22 is in extreme right-hand position, the dotted line the position D of the same parts with the arm 22 in the extreme left-hand position (FIG. 1).

The said extreme positions of the arm 22 are so arranged that, during the passage of the wire from a completed coil to an empty reel the wire is brought into contact with the core of the empty reel.

In the particular embodiment here shown the said extreme positions of the arm 22 are symmetric to the vertical symmetry plane separating the two reels.

The length of the arm 28 and its angular distance from the arm 22, that is, the reciprocal position of the pulleys 25 and 29, as will be described in more detail hereinbelow, is a function of the fixed outlet point of the wire leaving the said wire supplying machine.

As shown in the figures, in which the said fixed wire outlet point is found in direction of the upper righthand corner of FIG. 1, the projection of the centers of the two pulleys 25 and 29 and of the fulcrum of the arm 22 onto the plane of the said figure are more or less at the apices of an ideal equilateral triangle.

A locator body 35 is so positioned that its own symmetry plane coincides with the vertical symmetry plane of the two reels 2*a* and 2*b*.

The said body 35 has the shape of a prism with the two lateral faces 35*a* and 35*b* being parts of cylindrical surfaces each embracing at the top the sector of a reel at the upper part thereof and turned toward the other reel.

The projection of the two faces 35*a* and 35*b* onto the vertical plane of FIG. 1 determines two circumferential arcs almost tangential to the periphery of the two flange straps 19, while a third lateral face 35*c* has a flat surface with its projection on the vertical plane of FIG. 1 determining a horizontal rectilinear segment tangential to the two faces 35*a* and 35*b*.

The said body is moved by the piston rod 36 hydraulically or pneumatically controlled by the cylinder 37 fixed to the supporting frame 1 of the machine and is supported by a rod 71 parallel to the path of the said piston rod 36 on which it is resting with its edge 35'.

The stroke of the piston rod 36 is so controlled that it carries the body 35 alternately from an extreme right-hand position E (FIG. 3) to an extreme left-hand position F shown by dotted lines with the front part of the body slightly interposed between the flange straps 19 and viceversa.

At its lower part the body 35 has a flat surface 35*d* between two reels with its side turned toward the centers and is characterized by a thin edge 39 vertically rounded off which, when the body 35 is in its extreme left-hand position, is interposed between the flange straps 19.

The said vertical edge 39 is at such a level that it will intercept the wire when passing from a completed coil to an empty reel; more precisely at such a level that it is intercepting the ideal right tangents at the same time at the upper edge of one reel groove and at the lower edge of the other one.

At the same level with the thin edge 39 in an intermediate position between the two flange straps 19 and inside the space between the two reel cores there is a vertical rod 40 carried by a supporting frame 41 with its fulcrum on the vertical axis fixed to the frame 1 of the machine and controlled by a hydraulic or pneumatic cylinder 42.

The stroke of the piston of cylinder 42 moves rod 40 from a position near the reel 2*a* to one near reel 2*b* and viceversa.

The operation of the machine is as follows.

The leading end of the wire supplied by the wire supply machine upstream of the coiling machine is fixed by hand to the groove of the empty reel 2*a* which, supported by the respective dead and live centers, is driven by the motor 9.

The arm 22 is in the extreme right-hand position C as shown by the continuous line in the figures : the wire runs over the pulleys 30 and 29 to the pulley 25 of the wire guide 24 which, automatically, by moving its rod 23 in an alternating rectilinear motion with a speed in function of the reel rotation speed and of the desired coiling pitch, ensures the uniform coiling of the wire on the reel 2*a*.

In this phase the locator body 35 is in the position F.

After a certain number of strokes of the wire-guide carrying rod corresponding to the completion of the coil on reel 2*a*, an electromagnetic circuit, automatically controlled by the machine elements and connected to the said electronic circuit, when acting on the control means of the cylinder 37, moves the locator body to the right-hand extreme position E and at the same time starts the rotation of the empty reel 2*b* in direction of the arrow B.

After a short interval of time, from two to four minutes, sufficient to allow the reel to reach a speed which is fast enough to receive the wire, the electro magnetic circuit engages the cylinder 52 which controls the rotation of the arm 22 and moves it to the position D as shown by the dotted line.

In this position the length of wire leading from the pulley 25 to the reel 2*a* is tangential to the reel 2*b*.

With the arm 22 in this position D and with the pulley 25 reaching the extreme position G at the right shown by the dotted line in FIG. 2, the said electromagnetic circuit moves the body 35 to the left until the same by means of a pivot 60 trips a first microswitch 61 stopping a short distance from the flange strap 19.

Together with the said feed movement of the body 35 the cylinder 42 automatically controls the displacement of the vertical rod 40 toward the initial position near the reel 2*a* from the position near the reel 2*b*.

At this point, when the pulley 25 reaches the extreme position H at the left, the body 35 is moved to the extreme position F at the left with its vertical edge 39 slightly interposed between the flange straps 19. In this phase the length of wire between the pulley 25 and the vertical edge 39 is pushed by the latter against the face of the flange strap facing the reel 2*b* and fitted with blades 16 so that one of the blades gripping the wire cuts the same and draws it around the reel 2*b*.

The length of wire between the coil on the reel 2*a* and the vertical rod 40 is, thanks to the latter, kept at a given distance from the blades 16 of the flange straps of the reel 2*a* to prevent its cutting.

The movement to the extreme position at the left of the body 35 makes the pivot 60 interact with the microswitch 62 controlling the operation of the brakes 20 on the disk of the center 3*a* carrying the reel 2*a*.

After the carrying out of the above operations the wire will now be coiled on the reel 2*b* controlled by the wire guide 24 kept constantly in position D with the pulley shown in dotted lines, while the completed coil on the reel 2*a* is now unloaded by any one of the known means.

For again returning the wire from the completed coil on the reel 2*b* to a new empty reel 2*a*, the above steps will be automatically repeated while the arm 22 travels from the position D at the left to C at the right.

The body 35 besides acting as locator body for the wire serves also to protect the wire during the coiling phase from the "whip-effect" caused by the end of the wire when cut from the coil during braking after passing the wire from one reel to the other one.

The position of the pulley 29 with respect to that of pulley 25 as mentioned hereinabove is a function of the fixed position of the point at which the wire leaves the wire supply machine, and the ideal position is given when the said fixed point is on the axis of the ideal segment connecting the two positions of the pulley 29 associated to the left- and right-hand positions of the arm 22.

Thus, the presence of the said pulley 29 and its positioning, during the travel of the pulley 25 of the wire guide from one extreme position to the another one, makes it possible to obtain the purpose of keeping the feed of the wire supplying machine practically constant, in fact, the length of wire which, during the travel of the wire guide, connects the said fixed wire outlet point to the reel to be coiled running around the pulleys 29 and 25 practically remains unchanged.

In addition, in the herein described machine the wire guide pulley can advantageously be positioned at a short distance from the reel cores.

The pulley 30 in turn has the task of advantageously enlarging the coiling angle of the wire around the pulley 29; in some particular cases its presence is absolutely necessary.

In the shown machine the two pulleys 29 and 30 have their respective centers aligned on the straight line connecting the centers of the pulleys 29 and 25.

The coordinated action of the locator body 35 and rod 40 ensures the perfect approaching of the wire to the blades 16 on the flange strap and the gripping of the wire by the empty reel.

Figure 5:
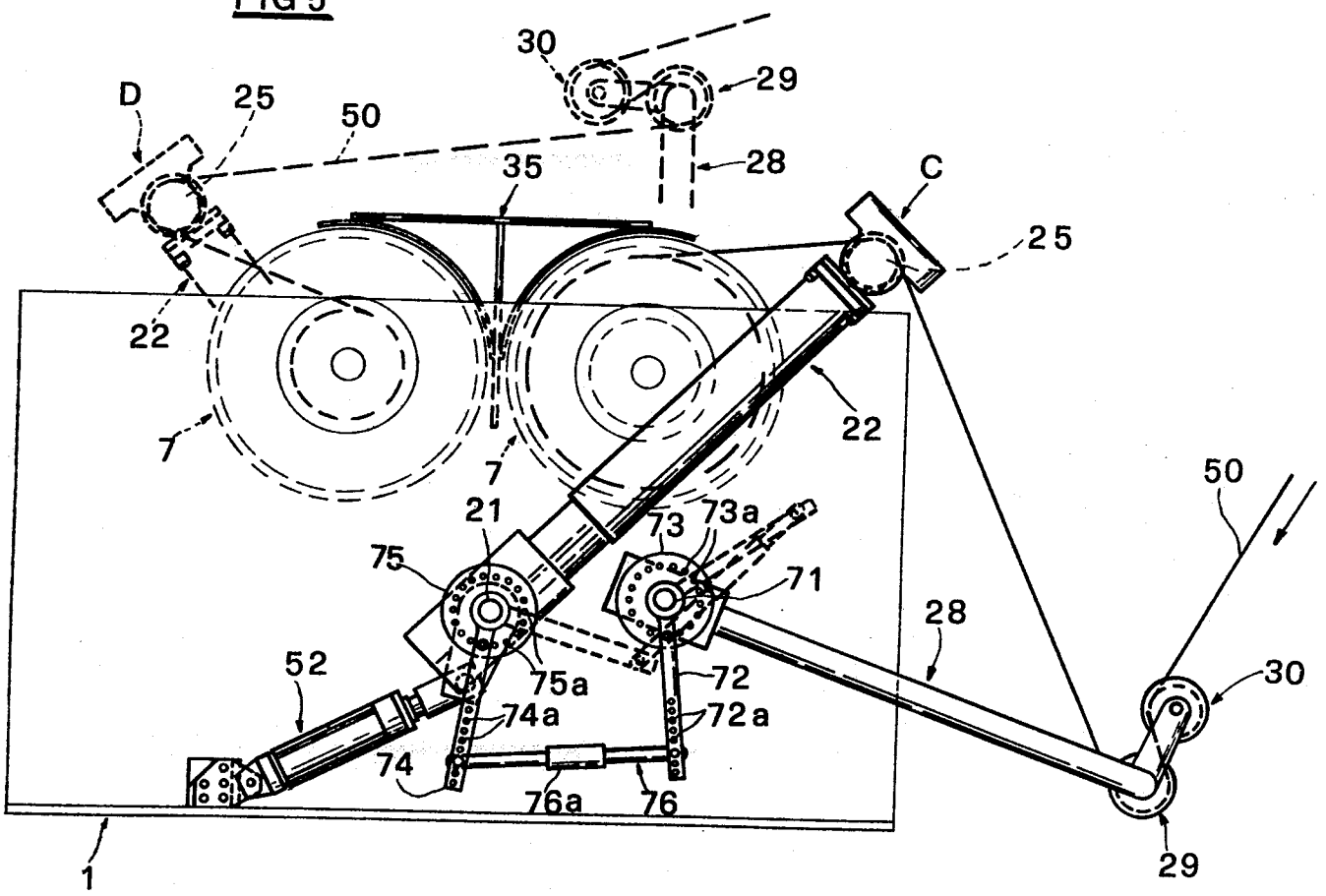
Figure 6:
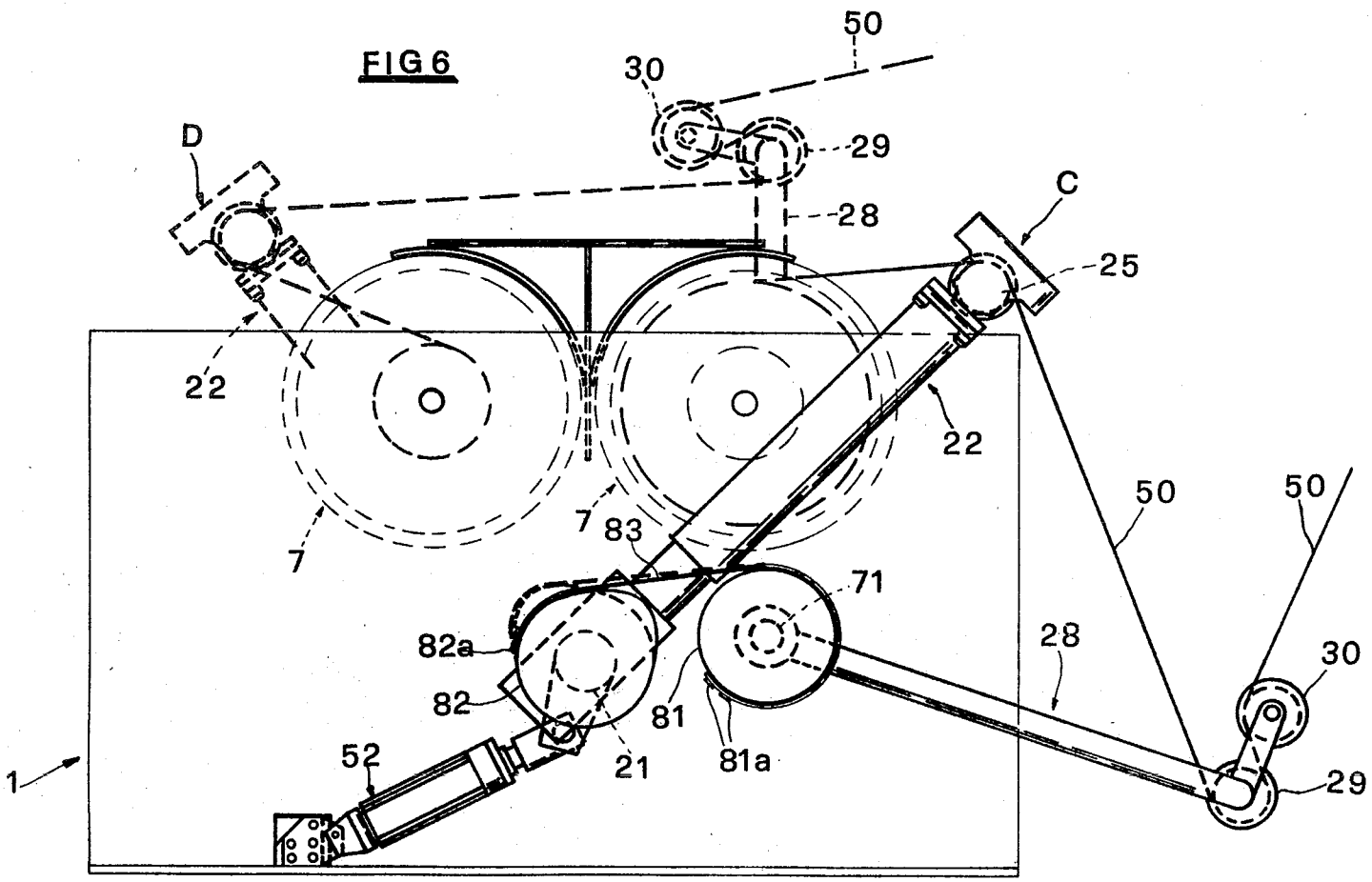

FIGS. 5 and 6 show two further embodiments of the coiling machine of the present invention in which, while leaving unchanged all the other parts, the arm 28 has its fulcrum on the machine frame 1 and has impressed thereon pendular oscillations which, together with those of the arm 22 are so timed that during the stroke of arm 22 from one extreme position to the other one, the length of wire connecting the wire outlet point of the wire supply machine to the coil to be wound passing around the pulley 29 of the arm 28 and the pulley 25 of the wire guide remains unchanged.

In the embodiment according to FIG. 5 the arm 28 has its fulcrum at 71 on the machine supporting frame and a lever 72 centered at the said fulcrum 71 is fixed by means of a pin or similar to a disk 73 part of arm 28.

Similarly a lever 74 is centered at the fulcrum 21 of the arm 22 by means of a pin or similar integrally fixed to a disk 75 integral part of the arm 22.

A connecting rod 76 easily extended as required by means of a sleeve 76*a* connects the said levers 74 and 72.

The disks 73 and 75 and the levers 74 and 72 are provided with a series of holes 73*a*, 75*a*, 74*a*, 72*a* allowing to adjust the respective position of the levers and connecting rod so as to ensure the pendular motion of the arm 28 in perfect synchronization of the arm 22 in function of the spatial position of the fixed wire outlet point of the wire supply machine.

In the embodiment according to FIG. 6, the arm 28 has its fulcrum at 71 on the machine supporting frame and a wheel 81 integral part of the arm 28 also with its fulcrum at 71.

At the same time a cam 82 fixed to the arm 22 is centered on the fulcrum 21.

A belt 83 or similar yielding to flexural stresses but rigid to traction connects the cam 82 to the wheel 81 and is partly wound around same and fixed by pins 81*a* and 82*a*.

The rotation of the cam 82 combines its own motion by means of the wheel 81 with the pendular motion of the arm 28 and the conformation of the cam 82 is such that it allows the pendular motion of the arm 28 in function of the spatial position of the fixed wire outlet joint of the wire supply machine.

The embodiments shown in FIG. 5 and 6 allow to keep the flow of wire coming from the wire supply machine perfectly constant.

The wire coiling machine according to the present invention can take other forms and embodiments differing from those here illustrated and numerous practical applications according to the following claims may be made thereto without leaving the range of the given claims.

What we claim and desire to secure by letters patent is:

1. A wire coiling machine for the continuous winding up of wire, particularly metal wire, in coils sequentially on two reels having parallel axes, comprising:

support means for supporting the two reels;

pulling means for ensuring the rotation of the two reels;

wire gripping means carried by said pulling means;

a wire guide with pulley for the uniform distribution of the wire being coiled;

a first arm carrying said wire guide, oscillatable between two extreme positions when the wire passes from a completely wound reel to an empty reel;

a second oscillating arm having a pendular motion synchronized to the motion of said first arm and fitted wth at least one idler pulley for partially receiving the wire before the wire reaches said wire guide pulley;

a locator body having a vertical edge in intermediate position between the two reels and oscillatable rectilinearly between two extreme positions along on axis parallel to the axes of the reels, said vertical edge being at such a level that it will interrupt the wire when it passes from one extreme position to the other;

thrust means for moving said locator body into a position where the vertcal edge will push the intercepted wire against the gripping means in association with the empty reel;

a vertical rod at the same level as said vertical edge of said locator body, carried and moved by levers in cooperaton with the motion of said locator body, said vertical rod being oscillatable between two extreme positions lateral to said vertical edge, said vertical rod maintaing the length of wire between the completed coil and said rod outside the interrupting zone of said gripping means of the completed coil reel.

2. A wire coiling machine according to claim 1, wherein the fulcrum of the oscillations of said first arm is equidistant from the reel axes.

3. A wire coiling machine according to claim 1, wherein said second arm is integrally fixed to said first arm and wherein said pulley of said second arm is so positioned that the fixed wire outlet point of the wire supply machine upstream of the wire coiling machine is located on an ideal axis of the segment connecting the two extreme positions of the said pulley during its oscillation together with said first arm.

4. A wire coiling machine according to claim 1, further including controlling means for causing said second arm to move with a motion synchronized to that of said first arm so that the length of wire between the fixed wire outlet point of the wire supply machine and the coil being wound, passing around said pulley of said second arm and that of the wire guide, remains unchanged.

5. A wire coiling machine according to claim 4, wherein said controlling means comprises a toothed cam centered at the fulcrum of one of said two arms, being connected by a belt or similar means yielding to flexure but rigid to traction to a wheel centered at the fulcrum and part of the other of said two arms.

6. A wire coiling machine according to claim 4, wherein said controlling means comprises a lever part of the first arm and connected with a rod to a second lever part of the second arm.

7. A wire coiling machine according to claim 1, wherein said first arm consists of two separate parts coaxially moving one within the other and said first arm is provided with means for locking said coaxial parts together in a desired position.

8. A wire coiling machine according to claim 1, wherein said second arm carries two idler pulleys which are so positioned as to ensure the advantageous coiling at advantageous angles on both reels.

9. A wire coiling machine according to claim 1, wherein said locator body has two cylindrical surface portions superiorly embracing the sector of one reel and turned at the top toward the other reel, and a vertical flat surface intermediate between the two reels.

* * * * *